United States Patent [19]

Christgau et al.

[11] Patent Number: 4,717,860

[45] Date of Patent: Jan. 5, 1988

[54] MOUNTING FOR AN OUTPUT WINDOW OF AN X-RAY IMAGE INTENSIFIER

[75] Inventors: Hermann Christgau, Fuerth; Norbert Mika, Buckenhof; Heinz Roehrich, Hoechstadt; Guenther Scholz, Erlangen, all of Fed. Rep. of Germany

[73] Assignee: Siemens Aktiengesellschaft, Berlin and Munich, Fed. Rep. of Germany

[21] Appl. No.: 806,818

[22] Filed: Dec. 10, 1985

[30] Foreign Application Priority Data

Dec. 10, 1984 [DE] Fed. Rep. of Germany ..... 3445007

[51] Int. Cl.[4] ..... H01J 43/28; H01J 9/26; H01J 9/40

[52] U.S. Cl. ..... 313/525; 313/544; 445/43; 445/44

[58] Field of Search ..... 313/524, 525, 544; 445/25, 43, 44

[56] References Cited

U.S. PATENT DOCUMENTS 3,173,201 3/1965 Motson ..... 29/473.1
3,458,744 7/1969 Sowers et al. ..... 313/526
3,510,925 5/1970 Fleck ..... 313/544 X
3,865,567 2/1975 Klomp et al. ..... 65/43

FOREIGN PATENT DOCUMENTS 2399300 8/1977 France .
167247 12/1981 Japan ..... 313/524
1482696 8/1977 United Kingdom .

*Primary Examiner*—David K. Moore
*Assistant Examiner*—K. Wieder
*Attorney, Agent, or Firm*—Hill, Van Santen, Steadman & Simpson

[57] ABSTRACT

An x-ray image intensifier having a tube bulb and an output window being mounted in a metal frame. The frame is inserted into the tube bulb and attached to the tube bulb in a region of the output window characterized by the output window being a glass window having a luminophor layer applied thereto, the output window being connected to the frame by only a single metal solder connection of soft solder so that the pane having the luminophor layer can be soldered to the frame without damaging the luminophor layer. Preferably, a peripheral edge of the window pane is free of the luminophor layer, and this peripheral edge has at least one adhesive layer deposited at the location for the solder connection.

14 Claims, 5 Drawing Figures

MOUNTING FOR AN OUTPUT WINDOW OF AN X-RAY IMAGE INTENSIFIER

BACKGROUND OF THE INVENTION

The present invention is directed to an x-ray image intensifier which has an output window that is mounted in a metal frame that is inserted into a tube envelope of the intensifier.

An electro-optical image intensifier having an output window which is mounted in a metal frame that is inserted into a tube bulb or envelope of the intensifier is disclosed in U.S. Pat. No. 3,458,744, whose disclosure is incorporated by reference thereto. As known, in the electronic image intensifiers of the type disclosed in this patent, an x-ray picture is converted into electron images which are then subjected to an acceleration voltage and are imaged on an output screen with the size of the image adjusted as needed. In x-ray intensifiers, which are usually fashioned one-stage, when the electron image has it image adjusted for size, the image, which appears on the output screen is also the image which is observed. This, however, presumes that the output screen can be seen through the wall of the bulb or envelope of the image intensifier. For this reason, the bulb or envelope has been manufactured of a transparent material, particularly glass, at least at the location of the output screen.

In order to obtain an expediently manipulable design solution, the window, which is inserted into the bulb, has been simultaneously made the carrier of the output luminescent screen. Since, in the known design solution, the output window is held by fusing the window in a metal frame, the luminescent screen cannot be applied until after this joint or fusion process has occurred. This, however, is a disadvantage because the yield of screens which are employable later is low because of the coating with the luminophor layer so that the connection of the glass pane to the frame, which must be carried out precisely, is frequently undertaken for panes which subsequently lead to screens which are not usable.

SUMMARY OF THE INVENTION

The object of the present invention is to provide an ray image intensifier wherein the finished output screen is mounted in the metal frame as an output window and can be inserted into the wall of the vacuum tube. To accomplish these goals, the present invention is directed to an improvement in an x-ray intensifier having an output window mounted in a metal frame, said frame being inserted into a tube envelope of the intensifier. The improvements are that the output window is formed by a window pane having a luminophor layer applied thereto and the output window is secured into the frame by a solder connection of a soft solder.

By employing a soft solder with a melting temperature in a range of 250 to 400° C. for soldering the window pane into a metal frame, which is then inserted into the window opening of the vacuum tube of an image intensifier by means of a flange, the invention obtains a solder connection which on the one hand is carried out at a temperature, which is as low as possible, and on the one hand a connection will resist the heating of an image intensifier. In order to preserve the luminescent screen, the formation of the solder connection is expediently undertaken in either an inert medium, a hydrogen protective atmosphere, in some other protective atmosphere or even in a vacuum. The soldering operation in the protective atmosphere or vacuum will not damage or cause deterioration of the luminophor layer so that the light yield from the layer will not be damaged or decreased.

Metals, which are stable in the manufacturing and operation conditions and which are tightly connectible to the material of the output window as well as to the material of the tube bulb of the image intensifer are suitable for the metal frame. Metals, which mave as a major constituent of either nickel or iron or alloys having major constituents either of nickel, chromium and iron or nickel, cobalt and iron or nickel, cobalt, chromium and iron have proven themselves for use in glass tubes. These are iron alloys which contain between 20 and 60% nickel and/or 10 through 30% cobalt and/or 1 through 10% chromium.

Solders, which are formulated on the basis of lead, have proven themselves for the soldering operation. In comparison to other solders, these solders have the advantage that their working temperature and their resoftening temperature lies clearly above the temperature which is necessary for the degasification heating of the image intensifier tube in the course of manufacture. However, the melting temperature for the solder is still below a temperature which would cause injury to the luminosity of the luminophor pigment.

In addition to lead, alloys wherein lead is alloyed with silver, tin and indium have also proven themselves. The additives are added to the lead in quantities with a range of between 0.1 weight percent up to 10 weight percent in order on the one hand to already achieve the effect of the additive given small amounts and, on the other hand, not to raise the melting temperature and cause formation of material inhomogeneities which makes the solder more difficult given higher quantities of the additive. An alloy of lead and 2.5 weight percent silver has proven favorable.

The wetting and adhesion of the solder on the parts to be joined can be promoted by adaptation of this surface. For example, by means of a simple coating or, respectively, coverage of a system of layers of materials adapted to one another. For glass, a simple adhesion layer or, respectively, the first layer of a suitable layer sequence should be composed of a material having great affinity to oxygen since the connection to the glass surface occurs via a metal oxide. Both the metal of the coating as well as the oxide formed at the boundary must have tensile strengths which are adequate for the desired connection.

The second layer is a protective layer for the first layer and can also be a solder layer. The second layer must stop the solder flux, namely, such that it does not detach from the first layer. A third layer, which will protect the first two layers against oxidation, can also be a solder layer.

Suitable materials for the layers are as follows: for the first layer, titanium, niobium, tantalum, chromium, iron and NiCr; for the second layer, nickel, gold, platinum, molybdenum and iron; for the third layer, gold, silver, nickel, copper, platinum and palladium.

Suitable systems of layers can be adapted to one another for soldering a glass pane. For example, they can be composed of a layer of sequence wherein chromium is first vapor-deposited onto the glass in a thickness of 30 through 300 nm. Given high vacuum during deposition of this layer, it must be presumed that the metallic chromium in the vapor phase and on the glass surface reacts with oxygen or, respectively, with thin oxide coatings. The actual adhesion thus occurs via an extremely thin chromium oxide layer which cannot be defined more specifically in terms of its composition. This first layer can then be followed by a second layer of nickel and, subsequently, by a third layer of silver whose thickness corresponds to that of the chromium layer.

The chromium layer, however, can also be coated with iron which is covered with nickel and which is then followed by a nickel-silver alloy or an iron-chromium-nickel alloy or a chromium-nickel alloy. All of these layers are deposited by a vapor-deposition process. During the coating sequence, caution must merely be exercised to see that the layers closest to the glass is constructed of a chromium oxide-chromium combination, that one layer is at least being 30 nm thick and is composed of pure chromium since chromium does not form any solid solution with lead and that the uppermost layer is composed of nickel or silver since good solubility of lead and therefore good bonding capability with the solder will be present with this upper layer. Finally, the overall coatings for improving adhesion can be covered with gold. Given adequate tightness, which is attainable with thicknesses of about 400 nm, this prevents the oxidation of the uppermost layer, i.e., for instance, it prevents the formation of nickel or silver oxide.

The metal frame can also be provided with the above-mentioned adhesion layers or coating at its surface which is to be soldered. Particularly when using either iron alloyed with 44% nickel and named Niromed 44, iron alloyed with 25% nickel and 21% cobalt named Vacon 20 or iron alloyed with 28% nickel and 23% cobalt named Vacon 70 as the frame material, good adhesion of the solder at this part is thus also achieved. The actual soldering preferably occurs in a high vacuum with layers thicknesses of 100 through 300 nm per individual layer. Soldering is carried out at temperatures of around 350° C. and a protective gas atmosphere, for example, an atmosphere of hydrogen, can also be employed instead of the high vacuum.

Additional advantages and objects of the present invention will be readily apparent from the following description and drawings.

DESCRIPTION OF THE PREFERRED EMBODIMENTS

Figure 1:
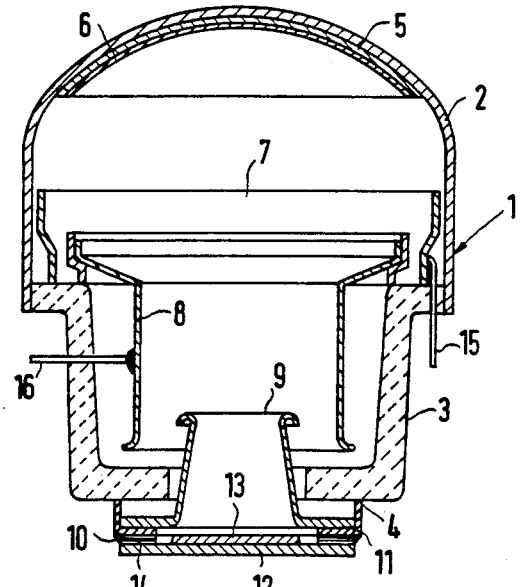
FIG. 1 is a cross-sectional view through a schematic illustration of a single-stage vacuum x-ray image intensifier.

The principles of the present invention are particularly useful when incorporated in a vacuum tube generally indicated at 1 for an x-ray image intensifier. The vacuum tube 1 is composed of a cathode cap 2 which closes an opening of a ceramic member 3 representing a tube with graduated diameters whose other opening has a smaller diameter in comparison to the first-mentioned opening and this other opening is closed by an anode setoff 4. The known structure of the electronic image intensifier is situated in the interior of the tube or envelope 1. For example, a luminophor layer 5 lies at the inside wall of the cap 2 opposite a setoff 4 and this luminophor layer 5 is covered with a photocathode layer 6. Then following are electron optical electrode 7 with a lead 15 and electrode 8 with a lead 16 which are secured to the ceramic member or sleeve 3 and, finally, the actual anode 9. A pane 12 of the output window lies at a frame 11 and is inserted by means of a solder connection 10 for closing the outwardly extending opening of the anode 9. As its inside, the pane 12 carries an output luminescent screen 13 and is connected vacuum-tight to the frame 11 with a solder connection or junction 14.

The manner of operation for the image intensifier, as known, is based wherein the x-ray picture penetrating through the wall of the cap 2 into the luminophor layer 5 triggers an electron image in the photocathode 6. This electron image is then imaged onto the luminophor layer 13 by mean sof the electrodes 7 and 8 and the anode 9 wherein appropriate voltages are applied to the cap 2, the connecting leads 15 and 16 for the electrodes 7 and 8 and to a setoff 4 for the anode 9.

Figure 3:
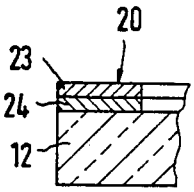
FIG. 3 is a partial cross-sectional view of one embodiment of the adhesion layers.
Figure 2:
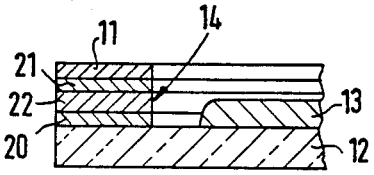
FIG. 2 is a partial cross-sectional view of a connection of the output window to a tube envelope of the image intensifier.

It may be seen from FIG. 2 that the solder location 14 between the pane 12 and the inside of the frame 11 is composed of adhesive layers 20 on the pane 12 and adhesive layer 21 on the frame 11 which adhesive layers 20 and 21 are connected to one another by means of an actual solder layer 22. The solder layer 22 is preferably composed of an alloy product of lead with 2.5 weight percent silver and is 0.05 through 1 mm thick. Each of the layers 20 and 21 are multiple layers. As illustrated in FIG. 3, the layer 20 is composed of double layers 23 and 24 with the layer 23 being a layer of nickel which is roughly 200 nm thick and the layer 24 being composed of a vapor-deposited layer of chromium which is at least 30 nm thick.

Figure 4:
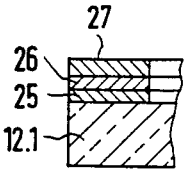
FIG. 4 is a partial cross-sectional view of a second embodiment of the adhesion layers.

Instead of being double layers, the layers 20 and 21 can be constructed of three layers such as 25, 26 and 27 as best illustrated in FIG. 4. In this embodiment, the layers are vapordeposited onto an output window 12.1 which corresponding to the window 12 of FIG. 2 and the layer 25 is formed of chromium or, respectively, chromium oxide, and is at least 30 nm thick and is first vapor-deposited onto the surface of the window 12.1. A layer 26 of nickel which is at least 30 nm thick is then vapordeposited onto the first layer 25 and finally a layer 24 composed of silver and roughly 200 nm thick is then vapor-deposited onto the nickel layer 26.

Figure 5:
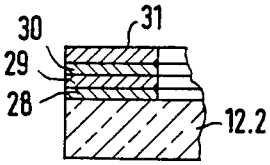
FIG. 5 is a partial cross-sectional view of a third embodiment of the adhesion layers.

In a third embodiment, four layers or coatings are utilizd and are illustrated in FIG. 5. Here a pane of the output window 12.2 has a first layer 28 of chromium or chromium oxide which is first vapor-deposited to at least a thickness of 30 nm on the edge of the window pane 12.2 which is to be involved with the solder connection. This layer is then covered by a vapordeposited layer 29 which is of nickel which has a thickness in the range of 100 nm through 300 nm. The nickel layer 29 is then covered by a layer 30 of silver which is vapor-deposited to a thickness of roughly 200 nm and finally a covering layer of 31 of gold is vapor-deposited onto the silver layer 30.

As a result of utilizing soft solder, the pane 12 can be subsequently detached from the bulb or tube 1 of the image intensifier. This is carried out by unsoldering from the frame 11. The pane 12 used as the substrate for the luminophor layer 13 can be unproblematically recovered, repaired and recoated with a new luminophor layer. Particularly given utilization of fine optical panes, this is a decided advantage over the soldering with glass solders which can only be detached at temperatures above 600° C. Whereas the soft solder is easily removable, a pane soldered with glass solder always has residues of glass solder at the solder locations after the soldering has been undone. These residues can only be removed by grinding, which increase the cost of resurfacing or renewing the luminophor layer.

Although various minor modifications may be suggested by those versed in the art, it should be understood that we wish to embody within the scope of the patent granted hereon, all such modifications as reasonably and properly come within the scope of our contribution to the art.

We claim:

1. In an x-ray image intensifier having a tube bulb and an output window being mounted in a metal frame, said frame being inserted into the tube bulb and attached to the tube bulb in the region of the output window, the improvements comprising the output window being a glass window pane having a luminophor layer applied thereto with a peripheral edge of the window pane being free of said luminophor layer, said output window being connected to the frame by only a single metal solder connection of soft solder with at least one adhesive layer being deposited on said peripheral edge at the location for the solder connection so that a pane having the luminophor layer can be soldered to the frame without damaging the luminophor layer.

2. In an x-ray image intensifier according to claim 1, wherein said soft solder is a lead alloy of lead, tin and indium.

3. In an x-ray image intensifier according to claim 1, wherein said soft solder is composed of an alloy of lead containing silver.

4. In an x-ray image intensifier according to claim 3, wherein the quantity of silver and said lead silver alloy is in a range of 0.1 to 10 weight percent.

5. In an x-ray image intensifier according to claim 4, wherein the amount of silver is approximately 2.5 weight percent.

6. In an x-ray image intensifier according to claim 1, wherein said adhesion layers are applied in the form of a layer sequence with a chromium layer being applied directly to the glass in a thickness of at least 30 nm, a nickel layer being applied to the chromium layer with a thickness of approximately 200 nm and a silver layer being applied to the nickel layer with a thickness in a range of 100 to 400 nm.

7. In an x-ray image intensifier according to claim 6, which includes an additional layer being applied to the silver layer, said additional layer being a layer of gold.

8. In an x-ray image intensifier according to claim 1, wherein said adhesion layers are applied in a layer sequence with a first layer of chromium with a thickness of 30 nm being applied directly to the glass surface, a layer of iron being applied directly to the first layer of chromium, a layer of nickel being applied directly to the layer of iron and a layer of silver being applied directly to the layer of nickel.

9. In an x-ray intensifier having a tube bulb and an output window being mounted in a metal frame, said frame being inserted into the tube bulb and attached to the tube bulb in the region of the ouput window, the improvements comprising the output window being a glass window pane having a luminophor layer applied thereto, said ouput window being connected to the frame by only a single metal solder connection of soft solder, and a solder area of the frame for the solder connection being provided with an adhesive layer so that a pane having the luminophor layer can be soldered to the frame without damaging the luminophor layer.

10. In an x-ray image intensifier according to claim 9, wherein the uppermost layer of said adhesion layer of said frame coincides with the uppermost layer of an adhesion layer on the window pane.

11. In an x-ray image intensifier having a tube bulb and an output window being mounted in a metal frame, said frame being inserted into the tube bulb and attached to the tube bulb in the region of the output window, the improvements comprising the output window being a glass window pane having a luminophor layer applied thereto, said output window being connected to the frame by only a single metal solder connection of solf solder and a solder area of both the window pane and the metal frame being provided with at least one adhesive layer so that a pane having the luminophor layer can be soldered to the frame without damaging the luminophor layer.

12. In an x-ray image intensifier according to claim 11, wherein each of the adhesion layers on the frame and window pane include an inner layer of chromium covered by a second layer of nickel.

13. In an x-ray image intensifier according to claim 12, wherein each of the nickel layers are covered by a layer of silver.

14. In an x-ray image intensifier according to claim 13, wherein each of the silver layers is covered by a gold layer.

* * * * *